US006258251B1

(12) United States Patent
Gowans et al.

(10) Patent No.: US 6,258,251 B1
(45) Date of Patent: Jul. 10, 2001

(54) ELECTROLYTIC CELL

(75) Inventors: Bruce S. Gowans, Hemel Hempstead; Nicholas J. Dartnell, Harrow, both of (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/348,132

(22) Filed: Jul. 2, 1999

(30) Foreign Application Priority Data

Jul. 13, 1998 (GB) ..... 9815169

(51) Int. Cl.[7] ..... B01D 17/06

(52) U.S. Cl. ..... 205/771; 205/702; 205/571; 204/272; 204/275.1

(58) Field of Search ..... 204/272, 242, 204/275.1; 205/571, 702, 771

(56) References Cited

U.S. PATENT DOCUMENTS 4,280,884 7/1981 Babb et al. ..... 204/109
4,372,829 2/1983 Cox ..... 204/109
4,744,876 * 5/1988 Bernard et al. ..... 204/245
4,804,452 * 2/1989 Rhodes ..... 204/238
5,017,273 5/1991 Woog ..... 204/105 R
5,370,781 12/1994 Van de Wynckel et al. ..... 204/280
6,071,399 * 6/2000 Van der Bergen et al. ..... 205/337

FOREIGN PATENT DOCUMENTS 647005 12/1984 (CH) .

* cited by examiner

*Primary Examiner*—Kathryn Gorgos
*Assistant Examiner*—Thomas H. Parsons
(74) *Attorney, Agent, or Firm*—J. Lanny Tucker

(57) ABSTRACT

An electrolytic cell for the recovery of silver from a photographic fixer solution is of generally cylindrical configuration. The cell has a screw-on lid that carries the disposable cathode of the cell. Inlet and outlet for the solution are at the bottom of the cell. The anode is tubular and extends upwardly from the outlet at the base of the cell towards the lid. The cathode is easily replaced, together with the lid, and flow through and the dimensions of the cell are arranged to avoid entrapment of gas therein.

18 Claims, 4 Drawing Sheets

ELECTROLYTIC CELL

BACKGROUND OF THE INVENTION

1. Field of the Invention

This invention relates to an apparatus for, and a method of, recovery of metal from solution, employing an electrolytic cell. The invention finds particular, though not exclusive application in the recovery of silver from photographic processing solutions, especially from the fixing stage thereof.

2. Description of the Related Art

For convenience and by way of example only, the invention will be described with reference to black and white photographic processing solutions and the recovery of silver therefrom.

Photographic material, in sheet or roll film form, is processed in several stages, including undergoing chemical development, fixing of the image, washing and drying. The role of the photographic fixing solution is to form soluble salts of any unexposed silver halide grains in the emulsion of the sensitized material. As more film is processed, the fixing solution becomes seasoned with soluble silver ion complexes. These complexes reduce the ability of the solution to fix the image, and thus affect its final quality. Ultimately, in some instances the solution could become too loaded with silver and it would be necessary to replace it with a totally fresh solution. However, environmental legislation is increasingly putting stricter limitations on the disposal of waste material bearing silver. Consequently, attention is increasingly being paid to safe and efficient recovery of the silver, and it is known to do this electrolytically. The advantages of in-line electrolytic recovery of the silver include:

(i) the lifetime of the fixing solution can be extended, (ii) the rate of fixing of the image can be increased, (iii) the rate of replenishment of the solution with fresh chemicals can be reduced, (iv) treatment of the effluent from the photographic processing is facilitated, (v) the value of the silver recovered is economically worthwhile; and (vi) reduced carryover of silver into the wash, with consequent lower silver concentration in the wash effluent.

In the electrolytic cell, silver is deposited on the cathode, and when this is full of silver action must be taken by the user of the equipment, and there are two options. The first option is when the cathode is reusable, in which case it can be taken out of the cell, the silver removed and the cathode then replaced. However, this is a messy and inconvenient operation for the user and can result in undesirable contact not only with the silver, but also with the processing solution since the cathode has been immersed in it. The other option arises when the cathode is a disposable one, whereby it is simply taken out of the cell and replaced with a fresh one. The fully-laden cathode can then be sent to a refiner who will put both the silver and the cathode into a smelting process. This is applicable when the cathode is made of a material which is both low-cost and compatible with the refining process.

Examples of such cathodes are those in which a plastics material is laminated to graphite or coated with conductive ink. Although this type of operation is less messy and inconvenient than that of the reusable cathode, it still can lead to the user having contact with the processing solution. The laden cathode is wet and the changeover operation may involve draining the cell or operating various taps and valves. Replacing the cathode may involve refilling the cell and bleeding the air out of it.

One example of an electrolytic cell is disclosed in CH-A-647005, in which there is an inlet opening at the base of the closed cylindrical cell through which solution is introduced tangentially. The outlet is at the other end (the top) of the cylinder at a tangent, or it is located in the middle. The outlet opening is two to four times the diameter of the inlet opening.

U.S Pat. No. 4,280,884 discloses a closed cylindrical electrolytic cell in which the cathode is attached to the lid of the cell and is reusable. After removing the lid together with the cathode from the cell, the cathode has to be detached from the lid and the silver scraped off before it is replaced in the cell. Solution flows into the cell from the base of a hollow tubular anode and out through a plurality of holes in the wall thereof, causing jets of liquid to be directed towards the cathode, which is in the form of a cylinder close to the outer wall of the cell. The solution leaves the cell from an outlet pipe towards the top thereof.

U.S. Pat. No. 4,372,829 also discloses a closed cylindrical electrolytic cell in which the cathode is attached to the lid. Solution flow into and out of the cell is arranged to be through the base thereof, and the lid is supplied with an air bleed valve. Each time the cathode is removed, air must be evacuated by the user through the bleed valve. The requirement for bleeding of the cell is inconvenient, requires a degree of operator skill, and is prone to leakage. The flow profile through the cell is such that the silver-laden fixer may reside therein for a time such that sulphiding, that is to say the formation of silver sulphide as a fine precipitate in the solution, can occur.

U.S. Pat. No. 5,370,781 discloses a closed cylindrical electrolytic cell employing a disposable cathode. A cathode is inserted into a tubular casing and when the lid is screwed down from above, electrical contact is made as the cathode is pressed against a contact point in the wall of the casing. To change the cathode, flow taps must be closed manually, the lid must be removed and the cathode gripped, either by hand or with a retracting tool, to remove it. Solution flows into the cell at the base, up through the cylinder formed by the cathode, through holes in the top of the cathode, and out of the cell through an upper port. An air gap is maintained at the top of the cell above the port to prevent contact between the solution and the connecting ring for the cathode, which would otherwise cause corrosion. Since the cathode has to be apertured for the flow of liquid therethrough, the area available for silver plating is reduced, thus reducing the silver capacity of the cathode, and leading to an increase in the cathode current density for a given recovery rate.

U.S. Pat. No. 5,017,273 discloses a cell containing a disposable cathode, in which the cylindrical cell body and the base are integrally moulded, with the cathode being mechanically fixed to the inner wall of the body. Solution is injected into the cell at an angle to the radius thereof, inducing a vortex, high agitation flow. The solution leaves the cell from an outlet towards the top thereof. In a first embodiment, a "double-container" configuration is employed that avoids the need for air bleeding and for a special drain operation during changeover of the cathode. However, since drainage of the solution is achieved under gravity through a small drain hole, it is possible for the user to remove the cell lid before the cell has been fully drained.

Furthermore, the air space that exists in this arrangement can allow oxidation reactions to occur with consequent disadvantages for the further processing of the photographic material. The space requirements and cost involved in the "double-container" configuration are also disadvantageous. A "single-container" arrangement is also disclosed. However, when it is required to change the cathode, the user has to empty out the trapped solution, which is a messy and inconvenient operation.

PROBLEM TO BE SOLVED BY THE INVENTION

It is an object of the present invention to provide an electrolytic cell that incorporates a disposable cathode, having an advantageous configuration. In particular, it is desirable that the construction of the cell avoids, or at least minimizes, possible contact of the user with the solution or with the metal to be recovered therefrom.

It is another object of the invention to provide a cell in which the cathode may be exchanged without requiring any significant skill of the user.

It is a further object of the invention to provide an electrolytic cell that avoids the need to drain or to refill the solution, or to bleed air, upon replacing the cathode.

SUMMARY OF THE INVENTION

In accordance with one aspect of the present invention, there is provided an electrolytic cell for recovering metal from a solution, comprising an electrically insulating container, having two ends, for containing the solution, a closure member for releasably closing one end of the container, an inlet and an outlet for the solution both located towards the other end of the container, a cylindrical cathode secured to and depending from the closure member so as to extend spaced from the inner surface of the container, and an at least partially tubular anode located substantially axially within the cathode, the anode being apertured to receive the solution only in that half of its length from one end adjacent the closure member, wherein the inlet communicates with the annular passage between the cathode and the anode and wherein the outlet is sealed to the bore of the anode towards its other end, whereby the flow path for the solution through the cell extends from the inlet, along the annular passage, into the bore of the anode towards the one end, and out through the outlet.

The aperturing of the anode may comprise a single opening or several openings which link the annular space between the cathode and the anode with the internal bore of the anode. The openings may be of any shape and may be disposed at any angle with respect to the axis of the anode and to perpendicular planes across it. In some cases it may be desirable to use openings which do not have a uniform cross-sectional area along their length, for example when using radiussed openings which eliminate high current densities associated with sharp edges. Each opening projects an area perpendicular to the flow and the maximum flow velocity through any opening is reached at the point of the smallest cross-sectional area along its length. It is the sum of the areas of all anode openings at their points of narrowest projected cross-section that defines the total area of the aperturing of the anode. A corresponding definition is also used for the cross-sectional area of the inlet to the cell, which may also comprise a single or several openings of any shape.

The anode may be in the form of a tube disposing an open, free end adjacent the closure member, extending towards the other end of the container.

The cell is advantageously arranged to be operated with the closure member forming an upper lid for the container, and with the solution being supplied into and withdrawn from the bottom thereof.

Advantageously, electrical contact with the cathode from the exterior of the cell is made by means of an electrically-conductive member sealed through the closure member thereof.

Preferably the closure member engages with the container by means of a screw thread, or bayonet fitting.

Preferably the inlet communicates with the interior of the cathode so as to induce vortex flow of the solution upon entry thereto, preferably by being directed at an angle with respect to the radius of the cathode. In this way, agitation of the solution in its passage through the cell can be ensured so as to enhance the efficiency of recovery of the metal therefrom.

Advantageously the cell does not need to be provided with a bleed valve, it preferably being arranged that any gas is expelled automatically by the flow of the solution therethrough. To this end, the inlet and the anode may be of substantially circular section, and the diameter of the bore of the anode may be larger than the diameter of the inlet. Thus, the diameter of the inlet of the cell, which determines the velocity of the incoming flow which should be as large as possible, presents the greatest flow restriction to the circulation of the solution through the cell. However, care has to be taken not to make the internal diameter of the anode too large whereby the velocity of the solution through the anode would be too low to be effective in removing the air. In such a disadvantageous configuration, a bubble of air could remain at the top of the cell, and if it is large enough it could at least partially obscure the uppermost portion of the cathode and hence reduce the available area for plating, or deposition.

Preferably, the total area of the aperturing of the anode is greater than, and less than four times, that of the inlet. Furthermore, in a preferred construction, the anode is of right cylindrical configuration.

Since the preferred orientation of the cell results in the free end of the bore of the anode, into which the solution flows after having been acted upon by the electric field between the cathode and anode, being in the upper part of the cell, large particles which may become dislodged from the cathode may be too heavy to be carried with the flow up through the cell and out via the anode. Such particles could remain trapped in the cell, settling out in the base each time the flow is stopped, even though smaller particles would be carried away with the flow of the solution. Advantageously, therefore, a trap is provided in the base of the cell into which particles will fall under gravity when the flow is stopped, the trap being such that the particles will not be sucked out again when the flow restarts.

Preferably the cell also has a drain hole in its lowest point, which may conveniently be situated in the trap, equipped with a valve. Thus, when it is necessary to perform maintenance on the cell, the solution may conveniently be drained, advantageously carrying away any trapped particles at the same time.

To avoid, or at least to minimize, the formation of "hot spots" of current density at the extremity of the electrodes, these are preferably radiussed, that is to say, to have rounded ends. Furthermore, where, as in a preferred embodiment, the anode extends beyond the cathode at the other, lower, end of the container, it is advantageous to provide an electrically insulating shield around this end of the anode, since otherwise the increased current density at the lower edge of the cathode would cause preferential plating of silver in that region. Such plating could not only impede the flow of solution through the cell but could also give rise to short circuits to the anode. Furthermore, the provision of such an anode shield assists in reducing the possibility of a short circuit between the anode and the cathode rising from any build up of conductive particles lying at the base of the cell after having fallen off the cathode. In an alternative configuration, the anode may be physically terminated at the lower end of the container so as to be co-terminus with the bottom rim of the cathode. In either case, therefore, the cathode and the anode are effectively electrically co-terminus.

In accordance with another aspect of the present invention, there is provided an apparatus comprising a tank of a photoprocessor for containing solution, preferably fixer solution, and an electrolytic cell in accordance with the said one aspect of the invention.

The electrolytic cell may be integrated into the photoprocessor, with a pump pumping the solution along a supply line from the tank, through the cell and back to the tank along a return line. In this configuration, the cell may be mounted substantially at the same level as, or above, the tank, with removal of air facilitated by the cell design in both locations.

Alternatively, the electrolytic cell may be remote from but connected to the tank of the photoprocessor in such a way as to operate in a more independent, stand-alone manner. In this arrangement the cell will usually be located below the level of the solution in the tank, and the removal of air is also facilitated in this location by the cell design. In such an embodiment, the electrolytic cell and a pump for the solution may form a flow loop with a by-pass pipe. The cell may be isolated by valves from the tank, to permit cell maintenance without draining the tank. In an alternative configuration, the flow loop may be linked with the processor tank by means of a reservoir.

In accordance with a further aspect of the present invention, there is provided a method of recovering metal from a solution wherein the solution is passed through an electrolytic cell that is in accordance with the first aspect of the invention, in which an electric potential is applied between the anode and cathode thereof so as to plate the metal on the cathode, and wherein the rate of flow of the solution through the cell and the dimensions of the cell are arranged such that the cell is maintained substantially full of solution with substantially no gas trapped therein.

Preferably, the dimensions are selected from the transverse dimension, preferably diameter, of the bore of the anode, the transverse dimension, preferably bore, of the inlet, and the spacing of the free end of the anode from the closure member.

ADVANTAGEOUS EFFECT OF THE INVENTION

The cell of the present invention has the cathode secured to the closure member, advantageously a screw-on lid, and thus when oriented with the lid uppermost, removal of the cathode can be made without the operator having to contact the silver or the solution. Contact with the solution is further avoided by having the inlet and outlet of the cell at the other, bottom end of the container.

The flow of the solution through the cell of such configuration can also conveniently be arranged so as to avoid entrapment of any air or other gas therein. The profile of the flow through the cell can be arranged such that the metal-laden solution, for example silver-laden fixer, resides therein for only a short time, so that the change in average metal concentration during the residence is short. In this way, the opportunity for sulphiding, of fixer solution, for example, to occur, especially in the otherwise vulnerable location at the top of the cell, is minimized.

The electrolytic cell is such that it may be integrated into a photographic processor, thus avoiding, the need for any valves or taps, or, alternatively, it may be provided as a stand-alone arrangement.

Since there is no requirement for solution to flow through the surface of the cathode, its entire surface area is available for chemical reaction.

The automatic expulsion of gas from the cell by suitably arranging the flow of solution therethrough can be achieved regardless of whether the cell is mounted above, alongside or below a tank, for example a photo processing tank, to which it is connected, without necessitating an extra holding tank for solution, and without requiring the cell to be equipped with a bleed valve.

It will be appreciated that the construction of the cell of the present invention allows the lid to be formed simply and inexpensively, since the connections for the flow of solution through the cell do not need to pass therethrough.

BRIEF DESCRIPTION OF THE DRAWINGS

An electrolytic cell, and its operation with a photographic processor tank, will now be described, by way of example, with reference to the accompanying drawings, in which.

DETAILED DESCRIPTION OF THE INVENTION

Figure 1:
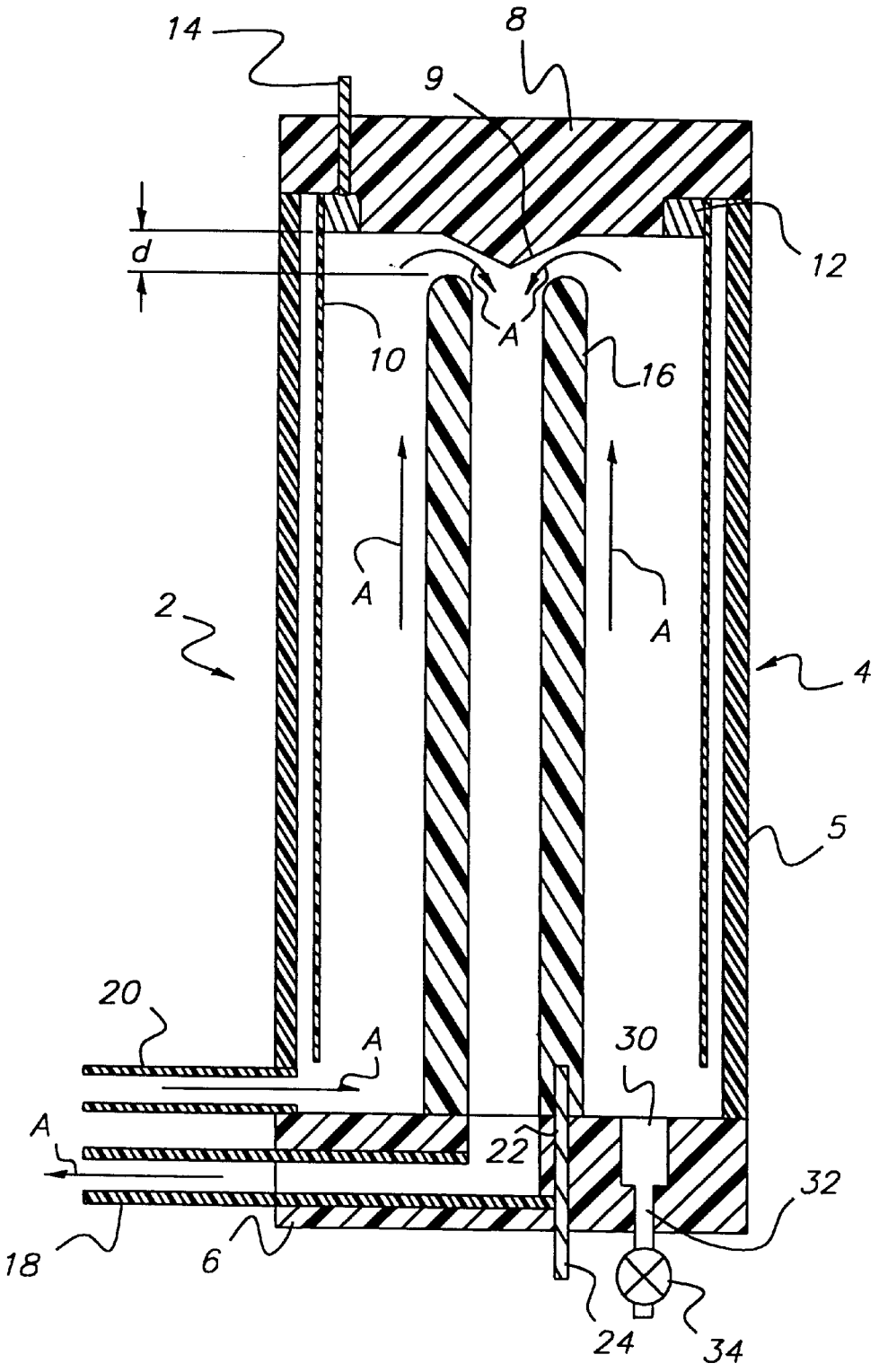
FIG. 1 is a schematic elevation of the cell.
Figure 2:
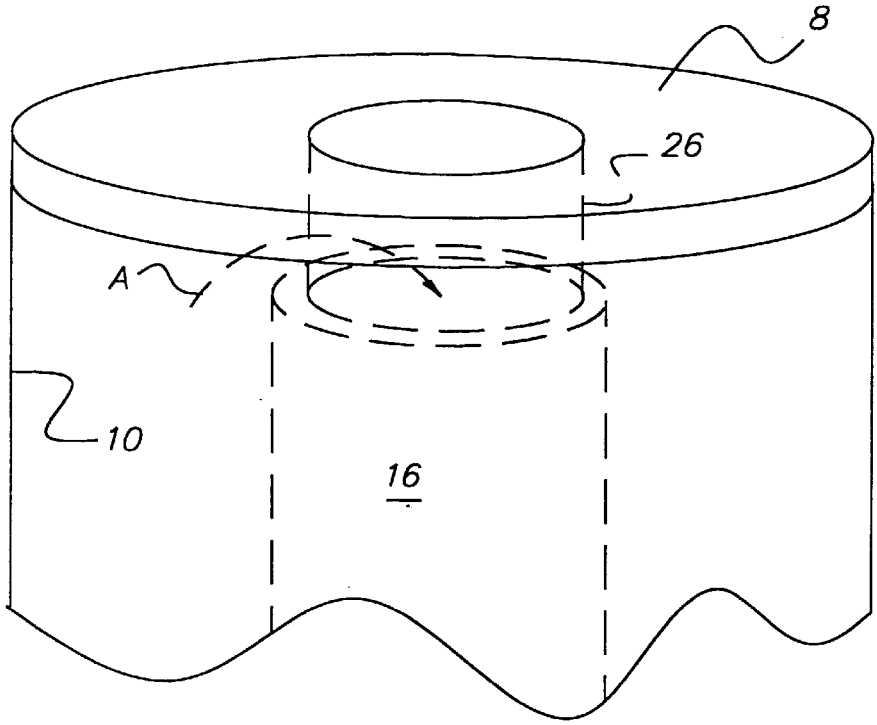
FIG. 2 is an enlarged view of an upper part of the cell of FIG. 1.
Figure 3:
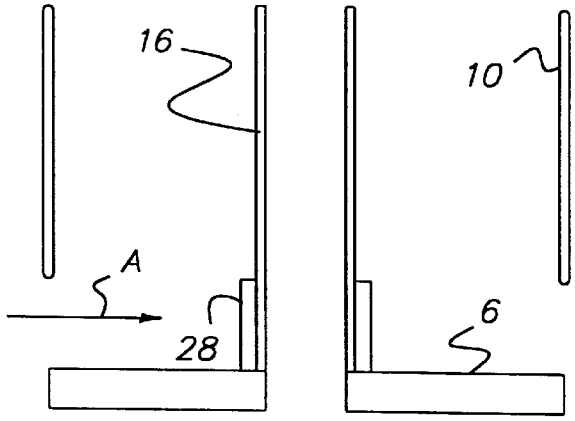
FIG. 3 is an enlarged view of a lower part of the cell of FIG. 1.

Referring to FIGS. 1 to 3, the cell 2 is formed from a container 4 having a cylindrical sidewall 5 that is closed by an end plate 6 at the bottom and a screw-on lid 8 at the top. The container 4 is made from an electrically insulating material that is inert to the solutions to be passed therethrough. A cylindrical cathode 10 formed from graphite foil laminated to polyester film is secured to the inner surface of the lid 8 and extends downwardly therefrom towards the container end plate 6, spaced apart from the container side wall 5. The lid 8 carries an internal metal connection ring 12 that provides electrical connection from the cathode 10 to a connection point 14 externally of the lid 8.

A tubular stainless steel anode 16 extends axially upwardly from the end plate 6 to terminate with a clearance d at its upper end from the inner surface of the lid 8. The bore of the anode 16 communicates at its lower end with an outlet 18 that extends through the end plate 6 and exits transversely of the container 4. Solution is supplied into the container 4 through an inlet 20 through the lower end of the side wall 5 of the container 4 adjacent the outlet 18. The inlet communicates with the annular gap that extends up the height of the container 4 between the anode 16 and the cathode 10. The inlet 20 is angled with respect to the radius of the container 4 so as to provide a vortex flow of the solution as it enters the cell 2.

Electrical connection to the anode 16 is made via a conductor 22 that extends downwardly through the end plate 6 to a connection point 24 on the outer surface thereof.

Flow of solution through the cell 2 takes place in the direction of the arrows A as shown in FIG. 1. After such flow has progressed under the influence of a potential difference between the cathode 10 and the anode 16 for a time such that the cathode 10 has become sufficiently laden with silver from the solution, the cell is switched off. The lid 8 can then be unscrewed and removed from the cell 2, carrying the silvered cathode 10 away for refining. A fresh lid and cathode can then be screwed on to the cell and operation thereof continued.

The risk of corrosion of the anode and other metal parts in the cell can be minimized by ensuring that gas is efficiently expelled from the cell. The following factors are relevant in ensuring this: the flow rate of the solution through the cell, the diameter of the bore of the anode, and the clearance d between the top of the anode 16 and the cell lid 8.

In order to maximize the rate of flow of the solution through the cell 2 so as to aid agitation and to minimize its residence time therein, the diameter of the inlet 20 should present the greatest flow restriction to the recirculation pump to which the cell 2 is to be connected. Thus, the diameter of the bore of the anode 16 should be larger than the diameter of the inlet 20. The inlet diameter also determines the inlet velocity of the solution and this in turn drives the vortex flow profile within the cell. If the inlet diameter is too small, whilst the solution velocity will be high, the resistance to the flow presented by the inlet will also be high so reducing the flow through the cell, and the net effect will be to reduce the overall electrochemical performance of the cell. If, on the other hand, the inlet diameter is too large, thus increasing the flow rate through the cell, the solution inlet velocity will be low and the vortex flow will also be low thus reducing the mass transport of ions to the cathode surface arising as a beneficial effect of the vortex flow profile. The inlet cross-sectional area is therefore selected to co-optimize both the flow rate and the vortex effect.

Once the inlet diameter has been selected, the anode bore may also be selected. Next the anode clearance d is determined such that the surface area of the imaginary smallest cylinder which could be fitted as an extension beyond the upper end of the anode 16 and terminating perpendicularly to the inside of the lid 8, should be no less than the cross section of the bore of the anode 16, thus defining the lower boundary of the range of the anode clearance d. Referring to FIG. 2, the dotted line 26 represents the imaginary cylinder.

By way of example, the cell 2 may have the following dimensions:

| | |
|---|---|
| Cathode internal diameter | 80 mm |
| Flow rate | 4.5 liters per minute |
| Flow inlet diameter | 7 mm |
| Anode clearance | 10 mm |
| Anode outer diameter | 30 mm |
| Anode inner diameter | 10 mm |

It was found under these conditions that no air bubble was retained at the top of the cell 2. However, with a cell in which the inner diameter of the anode had been increased to 20 mm, it was found that air was trapped beneath the lid 8. In another example, when the bore of the anode was changed to 10 mm and the anode clearance set at 25 mm, it was found that air was still evacuated downward through the bore of the anode 16. It has been discovered that the performance of the cell in removing trapped air from the top is most sensitive to the velocity of the solution as it passes into the anode. This velocity is determined for a given flow rate, by the cross sectional area of the anode bore.

In experiments where the anode bore cross sectional area and the flow rate were varied, it has been determined that the velocity of the solution entering the anode should be at least 10 cm per second and preferably greater than 20 cm per second to facilitate rapid evacuation of air from the cell. It has also been discovered that air evacuation may be further facilitated by the shaping of the inner surface of the cell lid directly above the entrance to the anode. If the anode is positioned symmetrically within the cylindrical cathode, the point of minimum angular velocity of the solution and of minimum solution velocity into the anode will occur at this position. It is therefore beneficial to profile the inner surface of the lid to protrude downwards slightly towards the anode entrance without substantially affecting the flow, as shown by the conical projection 9 in FIG. 1.

As can be seen from FIG. 1, solution enters the cell 2 through the inlet 20 below the lower end of the cathode 10, and the anode 16 extends beyond the lower end of the cathode 10 to the end plate 6. Such a construction leads to an enhanced current density at the lower edge of the cathode 10 which could result in silver from the solution being preferentially plated in this region. Since such a thicker rim of silver could not only impede the flow of solution through the cell 2, but might also cause a short circuit across to the anode 16, it is preferred to shield the bottom of the anode 16 electrically from the solution, so that the exposed length of the anode 16 within the cell is approximately the same as that of the cathode 10. FIG. 3 shows such an insulating anode shield 28. It will be appreciated, however, that the lower end of the anode 16 could be terminated at the same level as the adjacent bottom end of the cathode 10, with, for example, an insulating support being arranged to mount the anode 16 on the end plate 6 of the cell 2.

Excessive current densities at the upper, free end of the anode 6 can be minimized by radiussing the edge thereof.

Since the outflow from the active volume of the cell 2 is at the upper part thereof, through the anode clearance d and downwardly into the bore of the anode 16, should any large particles be in the solution, for example by becoming dislodged from the cathode and being too heavy to be carried upwards with the solution flow, these will remain trapped in the cell 2, settling out in the base on the end plate 6 each time the flow is stopped. A trap 30, is thus advantageously provided in the end plate 6 so that particles falling into it under gravity when the flow is stopped are not disturbed when the flow restarts.

In order to facilitate maintenance on the cell, requiring draining of the solution therefrom, a drain 32 may be provided in the container 4 at the lowest point therein, in the end plate 6, which may be equipped with a valve 34. By locating the drain 32 in the trap 30, any particles can be removed from the cell 2 at the same time as solution is drained therefrom.

The electrolytic cell may be operated with a tank, for example a fixer tank of a photographic processor, in one of two ways. In a first configuration, the cell may be integrated into the processor with a supply line from the processor tank going to a pump, which pumps solution through the cell and along a return line to the tank. In this configuration, the cell may be mounted substantially at the same level as the tank, and part of the cell may be above the surface of the solution in the tank. In such a configuration, when the cathode of the cell needs to be changed, the pump is stopped and the cell lid unscrewed and removed together with the cathode. The venting of the cell to atmospheric pressure by opening the lid causes the solution in the cell to drop to the same level as that in the tank, so that replacement of the cathode can be made without any overflowing of the solution. Furthermore, there is no need to operate any valves or taps in the supply line.

In another configuration, the cell may be arranged as a stand-alone system, which may be mounted on a wall or in a housing so as to stand on the floor adjacent the associated tank.

Figure 4:
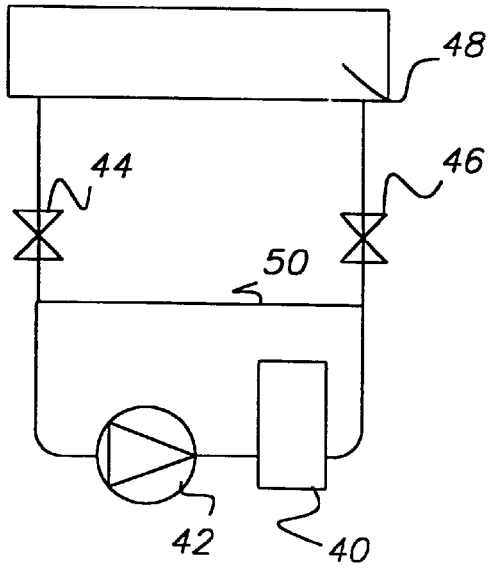
FIG. 4 is a first schematic arrangement of the cell and associated processor tank.

A first embodiment of this configuration will now be described with reference to FIG. 4. An electrolytic cell 40 is shown in circuit with a pump 42 connected by flow and return valves 44 and 46 respectively to a tank 48 of a photographic processor. The valves 44 and 46 may be solenoid valves, non-return valves, or be manually operated. A by-pass line 50 allows the cell 40 and pump 42 to be isolated from the tank 48. The by-pass line 50 also assists in obtaining a high flow rate through the cell, since without it there would be a very high flow to and from the tank 48 which could give rise to unacceptable turbulence on the surface of the solution in the tank with a consequent increase in evaporation and splashes. Furthermore, the cell 40 may be connected to the tank 48 such that the return to the tank 48 enters over the top of the tank wall and falls through a short distance of air before reaching the solution surface in the tank, thus avoiding siphoning. The pipe from the tank 48 to the cell 40 could be taken from an overflow pipe of the tank. In such a configuration it is very unlikely that high flow could be achieved since, typically, the diameter of the overflow pipe would be too small.

In a stand-alone configuration, the electrolytic cell is normally located below the level of the tank 48 such that the solution in the cell is under pressure. When the user desires to change the cathode of the cell 40, the valves 44 and 46 are closed to release the pressure, so that the lid of the cell may be safely opened without draining or needing to fill or to bleed the cell 40.

Figure 5:
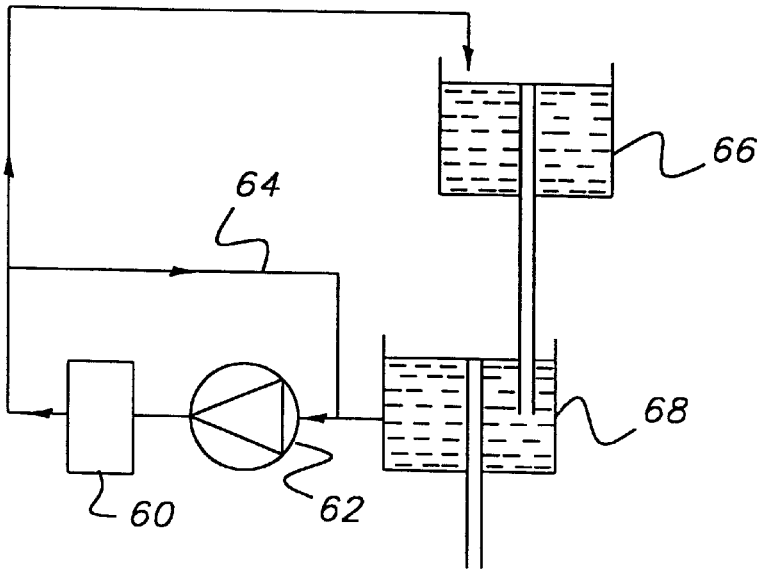
FIG. 5 is a second schematic arrangement of the cell and associated processor tank.

A further variant of the stand-alone cell is shown in FIG. 5. In this embodiment, a cell 60, pump 62, and by-pass line 64 form a loop. A processor tank 66 is arranged to overflow into a reservoir 68, and the input to the cell is taken from the reservoir 68, with the return going into the top of the tank 66. Employing a reservoir in this way, the cell 60 may be mounted so that the top is at the same height as the overflow of the reservoir 68, allowing the cathode of the cell 60 to be changed, as for the integrated configuration of the cell with the processor, without needing to isolate the cell by means of valves or taps.

Figure 6:
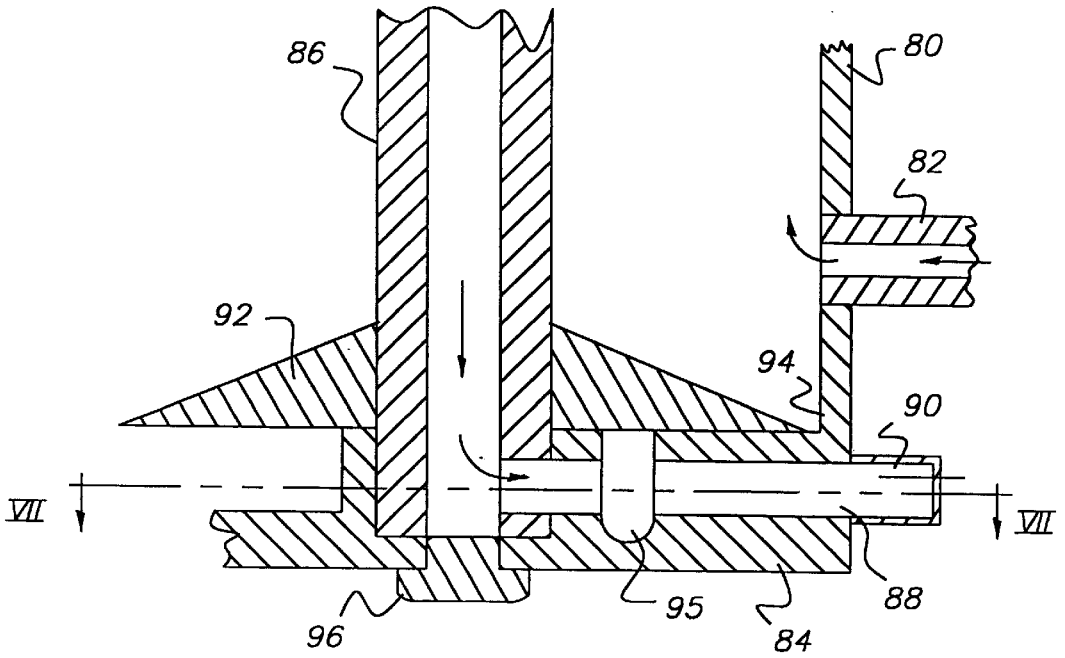
FIG. 6 is a schematic elevation of a lower portion of a modified cell showing a particle trapping arrangement.
Figure 7:
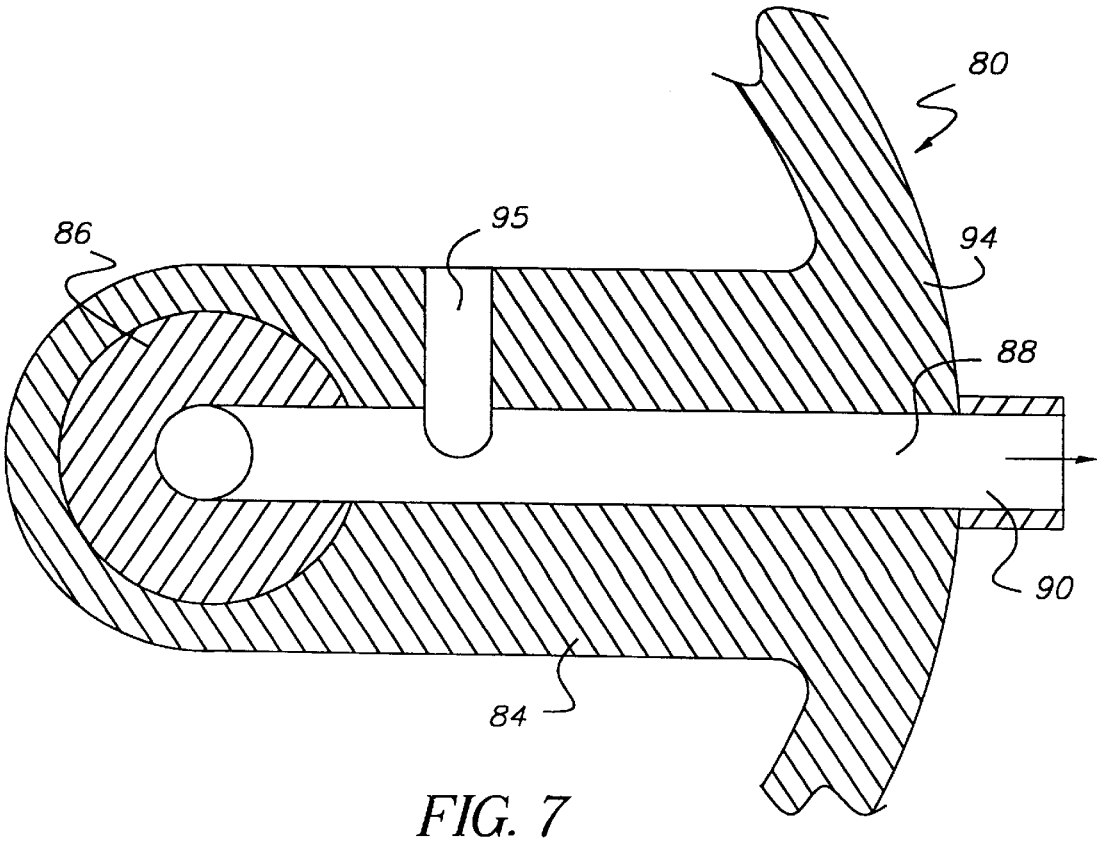
FIG. 7 is a partial section along the line VII—VII of FIG. 6.

FIGS. 6 and 7 show schematically a partial elevation and section respectively of a modification of an electrolytic recovery cell in order to enhance the efficiency of collection of any particles brought into or arising from reactions within the cell. Thus, the cylindrical cell 80 has an inlet 82 for solution above the base 84 thereof. The solution flows upwardly in the cell 80 in the annular region between the cathode (not shown) and the tubular anode 86, and thence downwardly through the anode and leaves the cell through a base channel 88 and thence through an outlet 90. A conical deflector 92 is provided around the lower end of the anode 86, so that any particulate material settling in the cell 80 will be deflected around the inner wall. The deflector 92 is raised off the cell base 84 by the radially-extending pipe 94 that defines the exit channel 88. If desired, a pathway may be formed between the space beneath the deflector 92 and the channel 88 by a hole 95 that extends through the side-wall of the pipe 94. The particulate material can thus be conveniently removed from the cell 80. At its base 84, the cell 80 is provided with a blanking plug 96 beneath the anode 86 for cleaning purposes.

The recovery of silver is dependent on the temperature of the solution, such that it is possible to recover silver safely to a lower silver concentration at higher solution temperatures.

For a stand-alone configuration of the electrolytic cell, where a by-pass loop is provided, a heater may be provided anywhere in the flow loop of the cell and by-pass. When the processor is running at operating temperature, there is no need to use the heater in the silver recovery cell. It will be common, though, for the silver recovery unit to be operated after the processor has been turned off at the end of a working day, in order to bring down the silver concentration in the processing tank to a lower level before switching off. During this period the temperature of the fixer solution will fall, and the silver recovery cell will not be able to recover to such low concentrations of silver. Thus, by providing a heater, these problems can be overcome without having to keep the tank hot overnight. The recovery cell will then process small batches of solution, say of the order of 2 liters, which are isolated from the processing tank by means of valves. Thus, relatively little energy is needed to maintain the higher temperature in the solution being processed. Furthermore, since the system is closed, there are no evaporation losses which occur when the processor heaters are on. When a batch of solution has been processed and taken down to the lower control limit, the valves may be opened, the processing solution returned to the processor tank, and a new batch brought in. The valves are then closed, and the new batch of solution can be brought up to a higher temperature whilst the recovery process is underway.

The invention has been described in detail with particular reference to certain preferred embodiments thereof, but it will be understood that variations and modifications can be effected within the spirit and scope of the invention.

We claim:

1. An electrolytic cell for recovering metal from a solution, comprising an electrically insulating container, having two ends, for containing the solution, a closure member for releasably closing one end of the container, an inlet and an outlet for the solution both located towards the other end of the container, a cylindrical cathode secured to and depending from the closure member so as to extend spaced from the inner surface of the container, and an at least partially tubular anode located substantially axially within the cathode, the anode being apertured to receive the solution only in that half of its length from one end adjacent the closure member, the bore of the anode forming a passageway to the outlet, wherein the inlet communicates with the annular passage between the cathode and the anode and wherein the outlet is sealed to the whole bore of the anode towards its other end, wherein the flow path for the solution through the cell extends from the inlet, along the annular passage, into the bore of the anode towards said one end, and out through the outlet.

2. A cell according to claim 1, wherein electrical contact with the cathode from the exterior of the cell is made by means of an electrically-conductive member sealed through the closure member thereof.

3. A cell according to claim 1, wherein the inlet and the outlet enter the container through a side wall thereof.

4. A cell according to claim 3, wherein the inlet communicates with the interior of the cathode so as to induce vortex flow of the solution upon entry thereto by being directed at an angle with respect to the radius of the cathode.

5. A cell according to claim 1, wherein the total area of the aperturing of the anode is greater than that of the inlet to the cell.

6. A cell according to claim 5, wherein the total area of the aperturing of the anode is less than four times that of the inlet.

7. A cell according to claim 1, comprising a trap, at the base of the cell for entrapment of particles.

8. A cell according to claim 1, wherein at said other end of the cell, the cathode and the anode are substantially effectively co-terminus.

9. A cell according to claim 1, wherein the aperturing of the anode comprises an open end thereof adjacent the closure member, and wherein the closure member is profiled so as to direct the solution into the open end of the anode.

10. A cell according to claim 1, of cylindrical configuration.

11. Apparatus comprising a cell for recovering metal from a solution, comprising an electrically insulating container, having two ends, for containing the solution, a closure member for releasably closing one end of the container, an inlet and an outlet for the solution both located towards the other end of the container, a cylindrical cathode secured to and depending from the closure member so as to extend spaced from the inner surface of the container, and an at least partially tubular anode located substantially axially within the cathode, the anode being applied to receive the solution only in that half of its length from one end adjacent the closure member, the bore of the anode forming a passageway to the outlet, wherein the inlet communicates with the annular passage between the cathode and the anode and wherein the outlet is sealed to the whole bore of the anode towards its other end, wherein the flow path for the solution through the cell extends from the inlet, along the annular passage, into the bore of the anode towards said one end, and out through the outlet, and a pump for pumping the solution therethrough, the cell and pump being arranged such that the average velocity of the solution within the entrance of the tubular anode is greater than 10 cm/sec.

12. Apparatus according to claim 11 comprising a heater for the solution.

13. Apparatus comprising a tank of a photoprocessor for containing solution wherein the solution is arranged to be passed through an electrolytic cell comprising an electrically insulating container, having two ends, for containing the solution, a closure member for releasably closing one end of the container, an inlet and an outlet for the solution both located towards the other end of the container, a cylindrical cathode secured to and depending from the closure member so as to extend spaced from the inner surface of the container, and an at least partially tubular anode located substantially axially within the cathode, the anode being apertured to receive the solution only in that half of its length from one end adjacent the closure member, the bore of the anode forming a passageway to the outlet, wherein the inlet communicates with the annular passage between the cathode and the anode and wherein the outlet is sealed to the whole bore of the anode towards its other end, wherein the flow path for the solution through the cell extends from the inlet, along the annular passage, into the bore of the anode towards said one end, and out through the outlet, for recovery of silver therefrom.

14. Apparatus according to claim 13, wherein a processor tank is connected to the electrolytic cell via valve means, and/or via a reservoir.

15. Apparatus according to claim 13 comprising a heater for the solution.

16. A method of recovering metal from a solution, wherein the solution is passed through an electrolytic cell comprising an electrically insulating container, having two ends, for containing the solution, a closure member for releasably closing one end of the container, an inlet and an outlet for the solution both located towards the other end of the container, a cylindrical cathode secured to and depending from the closure member so as to extend spaced from the inner surface of the container, and an at least partially tubular anode located substantially axially within the cathode, the anode being apertured to receive the solution only in that half of its length from one end adjacent the closure member, the bore of the anode forming a passageway to the outlet, wherein the inlet communicates with the annular passage between the cathode and the anode and wherein the outlet is sealed to the whole bore of the anode towards its other end, wherein the flow path for the solution through the cell extends from the inlet, along the annular passage, into the bore of the anode towards said one end, and out through the outlet, in which an electric potential is applied between the anode and cathode thereof so as to plate the metal on the cathode, and wherein the rate of flow of the solution through the cell and the dimensions of the cell are arranged such that the cell is maintained substantially full of solution with substantially no gas trapped therein.

17. A method according to claim 16, wherein the average velocity of flow through the tubular anode is arranged to be greater than 10 cm/sec, preferably greater than 20 cm/sec.

18. A method according to claim 16, wherein said dimensions are selected from the transverse dimension of the bore of the anode, and the transverse dimension of the inlet, and the spacing of the aperturing of the anode from the closure member.

* * * * *